US009744387B1

(12) United States Patent
Hung

(10) Patent No.: US 9,744,387 B1
(45) Date of Patent: Aug. 29, 2017

(54) FIXING DEVICE

(71) Applicant: YOKE INDUSTRIAL CORP., Taichung (TW)

(72) Inventor: Wei-Chieh Hung, Taichung (TW)

(73) Assignee: YOKE INDUSTRIAL CORP., Taichung (TW)

( * ) Notice: Subject to any disclaimer, the term of this patent is extended or adjusted under 35 U.S.C. 154(b) by 0 days.

(21) Appl. No.: 15/376,963

(22) Filed: Dec. 13, 2016

(51) Int. Cl.
*A62B 35/00* (2006.01)

(52) U.S. Cl.
CPC ..... *A62B 35/0068* (2013.01)

(58) Field of Classification Search
CPC ..... E04G 3/26; E04G 3/265; A62B 35/00
USPC ..... 248/351, 499, 237; 182/45; 52/749.12
See application file for complete search history.

(56) References Cited

U.S. PATENT DOCUMENTS

D254,534 S * 3/1980 Glynn ..... D8/349
4,249,713 A * 2/1981 Glynn ..... A62B 35/04 182/3
5,054,576 A * 10/1991 Glynn ..... A62B 35/04 182/3
5,287,944 A * 2/1994 Woodyard ..... A62B 35/04 182/3
6,668,509 B1 * 12/2003 Krebs ..... E04G 21/3261 248/499
7,665,248 B2 * 2/2010 Blackford ..... E04D 13/12 248/237
D646,553 S * 10/2011 Peng ..... D8/349
2007/0144830 A1 * 6/2007 Mastenbroek ..... A62B 35/0056 182/3

* cited by examiner

*Primary Examiner* — Steven Marsh
(74) *Attorney, Agent, or Firm* — Tracy M. Heims; Apex Juris, PLLC

(57) ABSTRACT

A fixing device adapted to be fixed on a structure is disclosed, which includes a connecting member, a first fixing plate, a second fixing plate, and a hanging ring. The connecting member has a base, a first bar, a second bar, and a third bar. The first bar and the second bar are respectively engaged with two sides of the base. The third bar is engaged with the base. The first and the second fixing plates respectively have a body adapted to be fixed on the structure, and two sleeves respectively fit around the first bar and the second bar, whereby the first and the second fixing plates are pivotable relative to the connecting member. The hanging ring is engaged with the third bar in a rotatable manner. Whereby, the first and the second fixing plates could be engaged with the structure to provide a firm supporting point.

9 Claims, 5 Drawing Sheets

FIXING DEVICE

BACKGROUND OF THE INVENTION

1. Technical Field

The present invention relates generally to a safety fixing device, and more particularly to a fixing device which is suitable for high-altitude operations.

2. Description of Related Art

According to the regulations regarding occupational safety and health (OSH) and equipment standards for safety and health in the construction industry, if there is a risk of falling during operations, the employer should take appropriate measures to prevent accidents and to ensure the safety of workers. Safety belts are commonly used in high-altitude operations to "stop" the falling. Therefore, the fixing strength of a safety belt is critical for determining whether the safety belt could provide its effectiveness. A common way to fix a safety belt is by providing a fixing device on the roof of the construction site, and an end of the safety belt is connected to the fixing device, while another end thereof is connected to the worker, whereby to protect the worker from falling accidents.

During a high-altitude operation, the design of a safety fixing device would also affect the efficiency and convenience of a worker. For instance, a conventional fixing device usually includes a ring used for connecting a safety belt, and the ring is not rotatable. Therefore, while the worker is moving around, the safety belt might wind around the fixing device, which seriously affects the movements of the worker, and confines his moving range.

In light of this, the conventional fixing devices still have room for improvements.

BRIEF SUMMARY OF THE INVENTION

In view of the above, the primary objective of the present invention is to provide a fixing device, which could enhance the security in high-altitude operations, and could improve the mobility of workers.

The present invention provides a fixing device, which is adapted to be fixed on a structure. The fixing device includes a connecting member, a first fixing plate, a second fixing plate, and a hanging ring. The connecting member has a base, a first bar, a second bar, and a third bar, wherein the first bar and the second bar are respectively engaged with two sides of the base, and the third bar is engaged with the base. The first fixing plate has a first body and two first sleeves, wherein the first body is adapted to be fixed on the structure; the first sleeves are connected to the first body, and respectively fit around the first bar and the second bar on two sides of the third bar, so that the first fixing plate is pivotable relative to the connecting member. The second fixing plate has a second body and two second sleeves, wherein the second body is adapted to be fixed on the structure; the second sleeves are connected to the second body, and respectively fit around the first bar and the second bar on two sides of the third bar, so that the second fixing plate is pivotable relative to the connecting member. The hanging ring is engaged with the third bar in a rotatable manner.

With the aforementioned design, the first fixing plate and the second fixing plate could be fixed on a structure, providing a firm supporting point for the fixing device. The rotatable hanging ring is adapted to be connected to a safety belt which is connected to a worker. Since the hanging ring is rotatable, it would be rotated by the safety belt when the worker moves. Whereby, the safety belt would not wind around the hanging ring.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
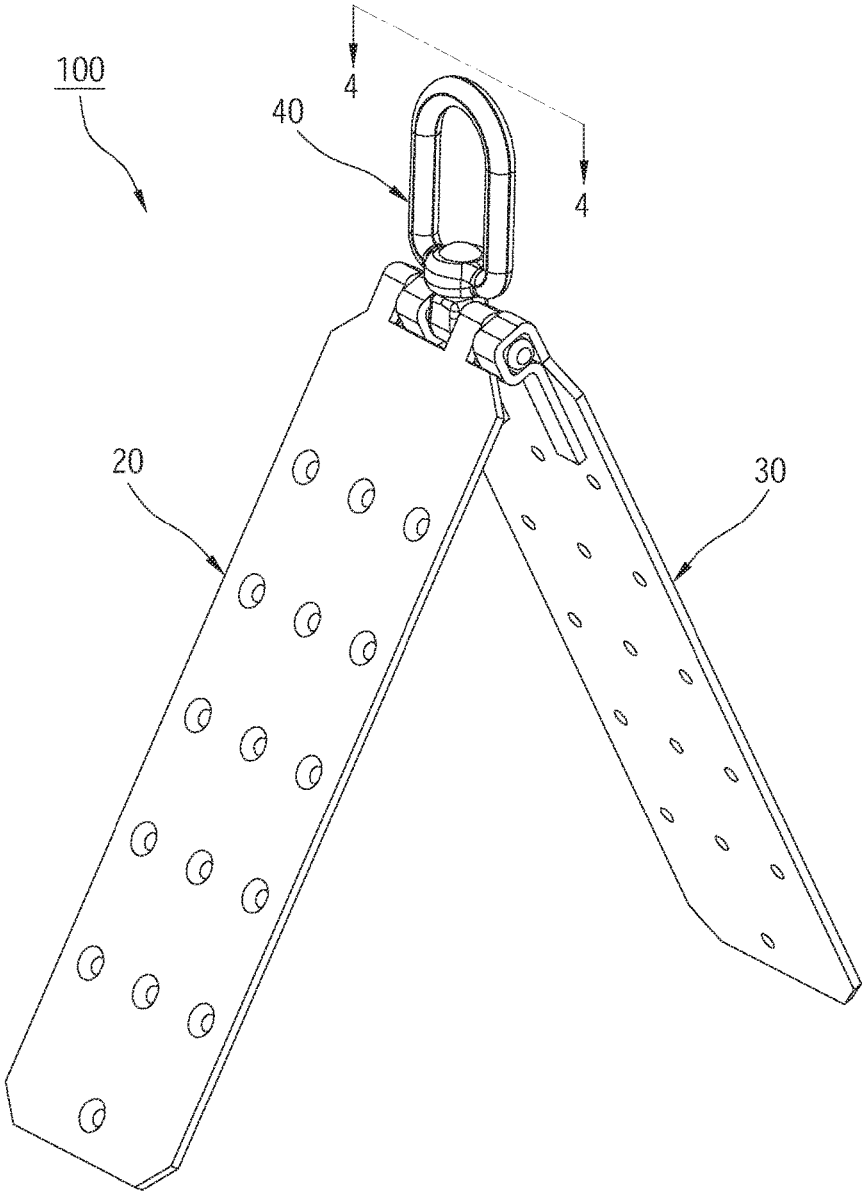
FIG. 1 is a perspective view of the fixing device of an embodiment of the present invention.
Figure 2:
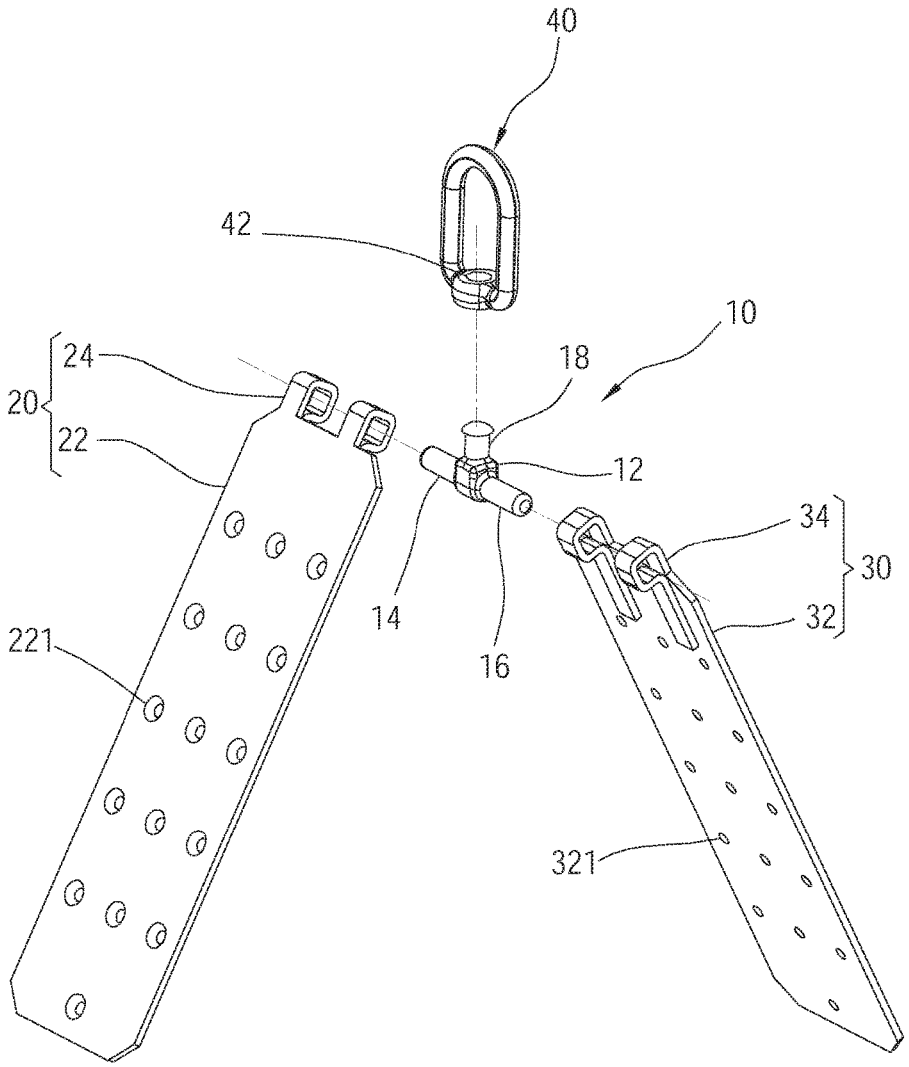
FIG. 2 is an exploded view of the aforementioned embodiment of the present invention.

A fixing device 100 of an embodiment of the present invention is illustrated in FIG. 1 and FIG. 2, including a connecting member 10, a first fixing plate 20, a second fixing plate 30, and a hanging ring 40.

The connecting member 10 has a base 12, a first bar 14, a second bar 16, and a third bar 18, wherein the first bar 14 and the second bar 16 are respectively engaged with two lateral sides of the base 12, and the third bar 18 is engaged with an upper side of the base 12. Preferably, the first bar 14 and the second bar 16 are located in an axial direction, and the third bar 18 is located between the first bar 14 and the second bar 16. In the embodiment, the base 12, the first bar 14, the second bar 16, and the third bar 18 of said connecting member 10 are integrally made, whereby to enhance the structural strength and the reliability. In other embodiments, the connecting member could be detachably assembled by each of the components to meet different requirements. It is worth mentioning that, in an embodiment, an axial direction of the third bar 18 is perpendicular to the axial direction of the first bar 14 and the second bar 16.

The first fixing plate 20 has a first body 22 and two first sleeves 24, wherein the first body 22 has a plurality of perforations 221. Each of the perforations 221 is adapted to be passed through by a fastener (not shown), and the first fixing plate 20 could be fixed in a structure through the fasteners. Said fasteners could be bolts, screws, rivets, etc. However, the selection of said fasteners is not a limitation of the present invention. In general, each of the fasteners substantially includes a head and a body which are connected together. The body of each of the fasteners is adapted to pass through one of the perforations as being fixed on the structure, and the head thereof is adapted to abut against a peripheral edge of the corresponding perforation of the first fixing plate 20, whereby to provide a positioning effect with a pressing force.

The first sleeves 24 of the first fixing plate 20 are connected to the first body 22, and respectively fit around the first bar 14 and the second bar 16, wherein the first sleeves 24 are located on two sides of the third bar 18. The first sleeves 24 could respectively pivot relative to the connecting member 10 around the first bar 14 and the second bar 16, so that the first fixing plate 20 could be pivoted relative to the connecting member 10.

The second fixing plate 30 has a second body 32 and two second sleeves 34, wherein the first body 32 has a plurality of perforations 321. Each of the perforations 321 is adapted to be passed through by a fastener (not shown), and the second fixing plate 30 could be fixed in the structure through the fasteners. Said fasteners are the same as the aforementioned fasteners. Thus we are not going to describe them again herein.

The second sleeves 34 of the second fixing plate 30 are connected to the second body 32, and respectively fit around the first bar 14 and the second bar 16, wherein the second sleeves 34 are located on two sides of the third bar 18. The second sleeves 34 could respectively pivot relative to the connecting member 10 around the first bar 14 and the second bar 16, so that the second fixing plate 30 could be pivoted relative to the connecting member 10.

Figure 3:
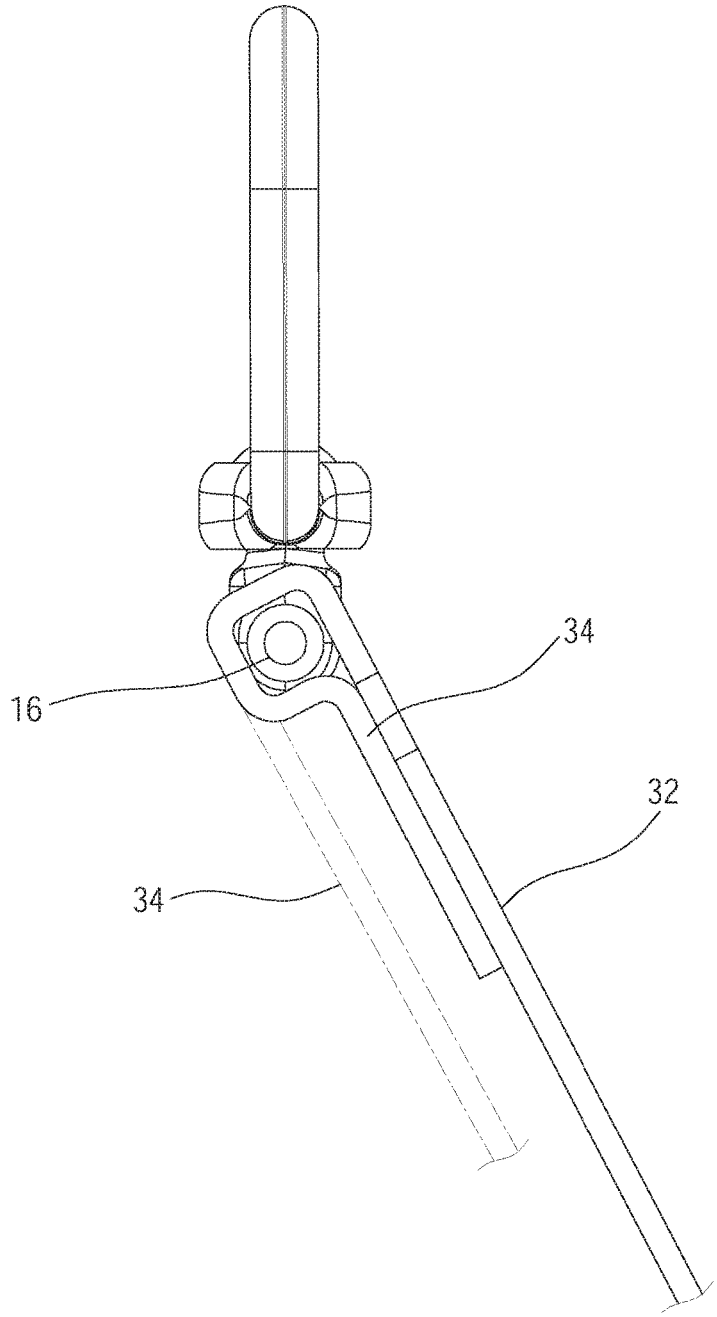
FIG. 3 is a side view of the fixing device of the aforementioned embodiment, showing how the sleeve is formed.

In the embodiment, the first sleeves 24 and the first body 22 of said first fixing plate 20 are integrally made, and the second sleeves 32 and the second body 32 of said second fixing plate 30 are also integrally made. Preferably, the first fixing plate 20 and the second fixing plate 30 are symmetrical. For ease of illustration, the second fixing plate 30 is taken as an example for explaining how the second sleeves 34 of the second fixing plate 30 fit around the connecting member 10. As shown in FIG. 3, one side of the second body 32 extends and forms two ribs 34', wherein each of the ribs 34' and the second body 32 substantially form a U-shaped notch therebetween. The U-shape notch between the second body 32 and each of the ribs 34' respectively could fit around the first bar 14 or the second bar 16 first. After that, the ribs 34' could be bent through stamping, extrusion, or other processing methods in a way that an end of each of the ribs 34' is bent toward the second body 32. As a result, the second sleeves 34 could be respectively formed to tightly and firmly fit around the first bar 14 and the second bar 16. As mentioned above, said first sleeves 24 could be also formed by bending two ribs (not shown) which extend from one side of the first body 22 through stamping, extrusion, or other similar processing methods.

Figure 4:
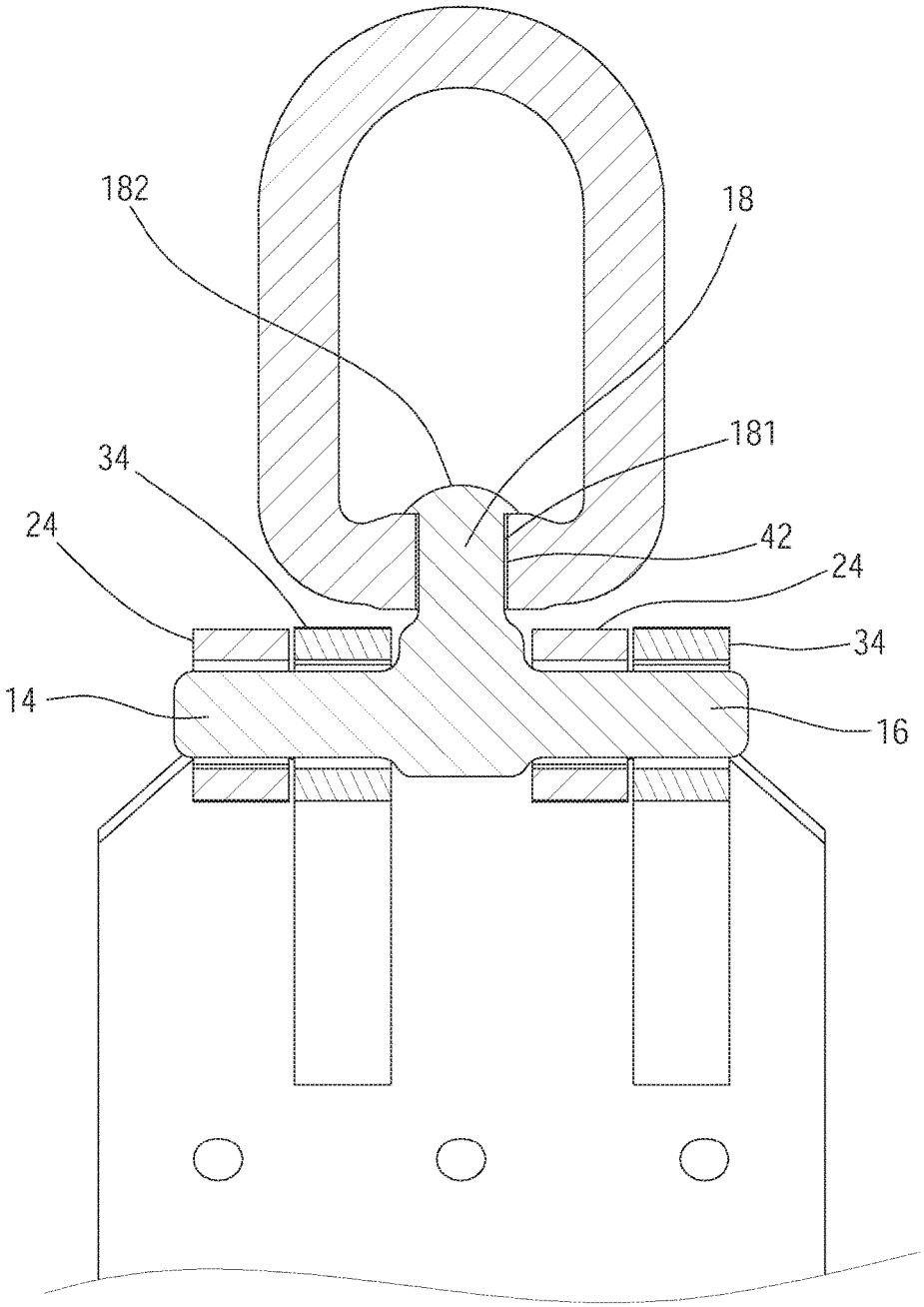
FIG. 4 is a sectional view along the 4-4 line in FIG. 1.

It is worth mentioning that, when the first sleeves 24 of the first fixing plate 20 and the second sleeves 34 of the second fixing plate 30 respectively fit around the first bar 14 and the second bar 16, the first sleeves 24 and the second sleeves 34 are provided in a staggered way, which provides better stability when the first fixing plate 20 and the second fixing plate 30 fit around the connecting member 10. In other words, as shown in FIG. 4, on the first bar 14, one of the second sleeves 34 is located between one of the first sleeves 24 and the third bar 18; on the second bar 16, the other one of the first sleeves 24 is located between the other one of the second sleeves 34 and the third bar 18. In this way, a movement of said first sleeves 24 in the axial direction of the first bar 14 and the second bar 16 would be confined or restricted by the third bar 18 and the second sleeves 34. Whereby, the first sleeves 24 would not easily fall off from the first bar 14 and the second bar 16. Similarly, a movement of said second sleeves 34 in the axial direction of the first bar 14 and the second bar 16 would be also confined or restricted by the third bar 18 and the first sleeves 24. Whereby, the second sleeves 34 would not easily fall off from the first bar 14 and the second bar 16. In this way, the first fixing plate 20 and the second fixing plate 30 could firmly fit around the connecting member 10, and would not fall off easily.

As shown in FIG. 2 and FIG. 4, the hanging ring 40 has a perforation 42 provided on a bottom thereof, and the third bar 18 has an axial neck 181, wherein a wall of the perforation 42 of the hanging ring 40 surrounds the axial neck 181, so that the hanging ring 40 could be engaged with the third bar 18 in a rotatable manner. A head 182 is formed at one end of the third bar 18, wherein a radial width of the head 182 is greater than a diameter of the perforation 42 of the hanging ring 40, whereby to prevent the hanging ring 40 from falling off from the third bar 18 after the hanging ring 40 is engaged with the third bar 18.

Figure 5:
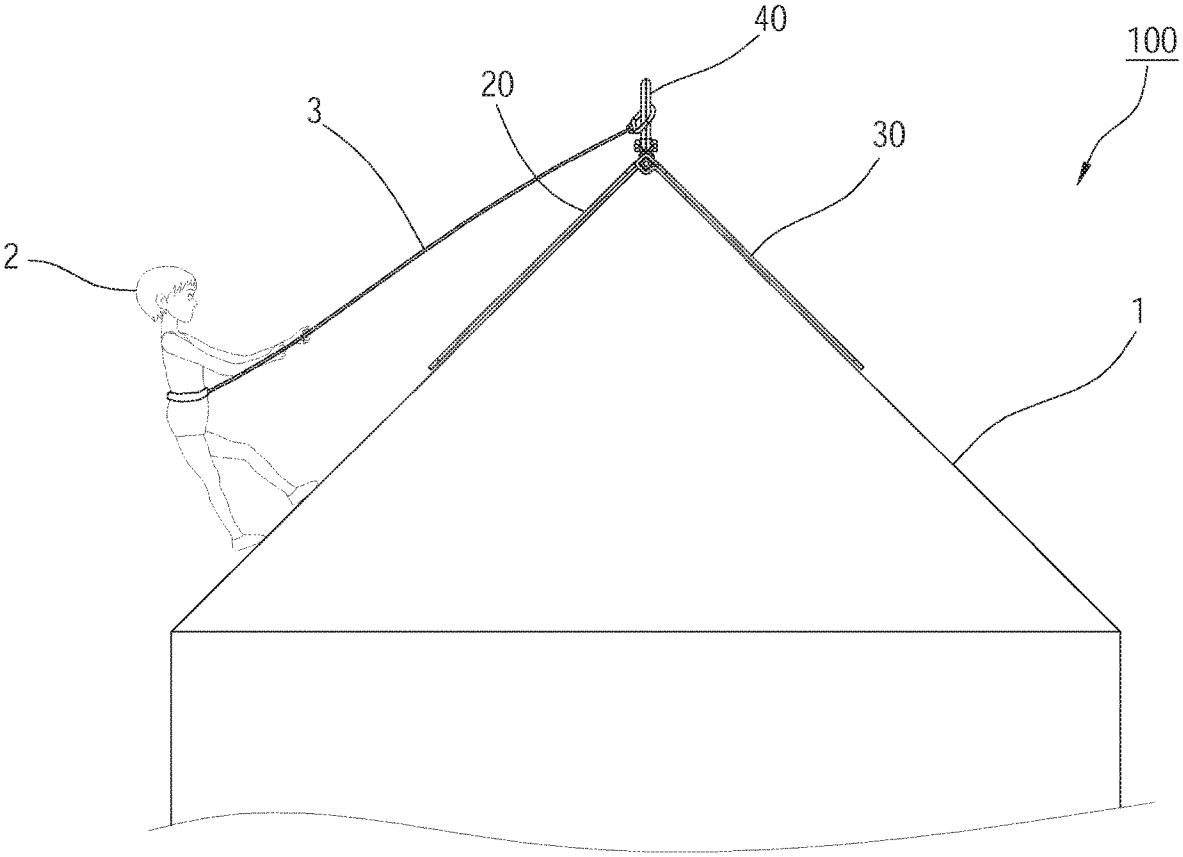
FIG. 5 is a schematic diagram, showing the fixing device of the aforementioned embodiment is in use.

A way of using the fixing device 100 of the present invention is illustrated in FIG. 5. Said structure is a roof 1 of a building as an example. With the first fixing plate 20 and the second fixing plate 30 which could pivot relative to the connecting member 10, an angle between the first fixing plate 20 and the second fixing plate 30 could be set according to an inclined angle of the building, whereby to respectively and tightly fix the first fixing plate 20 and the second fixing plate 30 on two sides of the roof 1, providing a stable supporting point. In this way, when a worker 2 works on the roof 1, an end of a safety belt 3 could be connected to the worker 2, and another end thereof could be connected to the hanging ring 40 to protect the worker 2 from falling from the roof 1. Since the hanging ring 40 is rotatable, it could be rotated by the safety belt 3 when the worker 2 moves, and the safety belt 3 would not wind around the hanging ring 40.

In addition, since a direction of a pulling force exerted on the hanging ring 40 by the safety belt 3 is usually parallel to, or nearly parallel to, a surface of the roof 1, and said first fixing plate 20 and the second fixing plate 30 are fixed on the roof 1 through the fasteners which are screwed in or go into the roof 1 in a nearly vertical direction, the pulling force exerted on the fixing device 100 generated by the safety belt 3 is substantially perpendicular to a force which fixes the fixing device 100 on the surface of the roof 1. Therefore, the first fixing plate 20 and the second fixing plate 30 of the fixing device 100 would not be easily pulled up by the pulling force of the safety belt 3. Whereby, the fixing device 100 could be stably fixed on the roof 1.

It must be pointed out that the embodiments described above are only some preferred embodiments of the present invention. The structure which the fixing device 100 of the present invention is fixed thereon is not limited to be the roof of a building. Said structure could be a wall, a beam, a column, a steel bar, or other building components. All equivalent structures which employ the concepts disclosed in this specification and the appended claims should fall within the scope of the present invention.

What is claimed is:

1. A fixing device, which is adapted to be fixed on a structure, comprising:

a connecting member having a base, a first bar, a second bar, and a third bar, wherein the first bar and the second bar are respectively engaged with two sides of the base, and the third bar is engaged with the base;

a first fixing plate having a first body and two first sleeves, wherein the first body is adapted to be fixed on the structure; the first sleeves are connected to the first body, and respectively fit around the first bar and the second bar on two sides of the third bar, so that the first fixing plate is pivotable relative to the connecting member;

a second fixing plate having a second body and two second sleeves, wherein the second body is adapted to be fixed on the structure; the second sleeves are connected to the second body, and respectively fit around the first bar and the second bar on two sides of the third bar, so that the second fixing plate is pivotable relative to the connecting member; and a hanging ring, which is engaged with the third bar in a rotatable manner.

2. The fixing device of claim 1, wherein, on the first bar, one of the second sleeves is located between one of the first sleeves and the third bar; on the second bar, the other one of the first sleeves is located between the other one of the second sleeves and the third bar.

3. The fixing device of claim 1, wherein the first bar and the second bar are located in an axial direction.

4. The fixing device of claim 1, wherein the third bar is located between the first bar and the second bar.

5. The fixing device of claim 1, wherein the first body and the second body respectively have a plurality of perforations; each of the perforations is adapted to be passed through by a fastener to fix the first body and the second body on the structure.

6. The fixing device of claim 1, wherein the third bar has an axial neck, and the hanging ring has a perforation; a wall of the perforation surrounds the axial neck.

7. The fixing device of claim 1, wherein the base, the first bar, the second bar, and the third bar of the connecting member are integrally made.

8. The fixing device of claim 1, wherein one side of the first body extends to form two ribs; the ribs are bent by stamping to become the first sleeves.

9. The fixing device of claim 1, wherein one side of the second body extends to form two ribs; the ribs are bent by stamping to become the second sleeves.

* * * * *